United States Patent [19]

Baikie

[11] 4,218,069

[45] Aug. 19, 1980

[54] ICE SKATE AND METHOD OF MANUFACTURE THEREFOR

[75] Inventor: Hugh E. Baikie, Chateauguay Center, Canada

[73] Assignee: Tuuk Sports Ltd., Ville St. Laurent, Canada

[21] Appl. No.: 928,081

[22] Filed: Jul. 26, 1978

[51] Int. Cl.[2] ..... A63C 1/30

[52] U.S. Cl. ..... 280/11.12; 280/11.18

[58] Field of Search ..... 280/11.12, 11.18, 11.17, 280/7, 13

[56] References Cited

U.S. PATENT DOCUMENTS

| | | | |
|---|---|---|---|
| 1,275,519 | 8/1918 | Becker | 280/11.17 |
| 2,150,964 | 3/1939 | Dornseif | 280/11.18 |
| 3,934,892 | 1/1976 | Baikie | 280/11.12 |
| 3,947,050 | 3/1976 | Isely | 280/11.18 |
| 4,074,909 | 2/1978 | Baikie | 280/11.12 |
| 4,139,209 | 2/1979 | Humphreys | 280/11.12 |

FOREIGN PATENT DOCUMENTS

| | | | |
|---|---|---|---|
| 585720 | 10/1959 | Canada | 280/11.17 |
| 58363 | 10/1946 | Netherlands | 280/11.12 |
| 495161 | 11/1938 | United Kingdom | 280/11.12 |

*Primary Examiner*—John J. Love

*Assistant Examiner*—Milton L. Smith

[57] ABSTRACT

Ice skate blades each having a main portion and an enlarged head are cut from contiguous areas of steel stock by cuts spaced such that each cut forms the upper edge of the main portion of one blade and the lower edge of the main portion of the next blade with the head portions cut alternately from those portions of the stock extending beyond the ends of the main portions. An upwardly extending lug is secured to the upper edge of one end of each blade to extend longitudinally towards the other end and a bolt is secured to or engages the other end of the upper edge and extends in the same direction as the lug. The upper edge of the blade is received in a downwardly facing groove in a skate superstructure with the groove having a slot at one end of the superstructure to receive the lug and with the bolt extending through a hole in the other end of the superstructure and having a fixing portion on the free end of the bolt for securing the blade in the groove. The fixing portion may be the head of the bolt or a nut and is received in a cavity in an external surface of an end wall of the superstructure. The blade may be formed without the enlarged head and used in a hockey skate with the blade with the enlarged head used in a figure skate.

7 Claims, 10 Drawing Figures

ICE SKATE AND METHOD OF MANUFACTURE THEREFOR

BACKGROUND OF THE INVENTION

This invention relates to the manufacture of ice skates and blades therefor.

While the main example illustrated and described below shows a skate having a blade of the type designed for figure skating, i.e. with a serrated front surface for biting into the ice, the invention is also applicable to skates having blades without this feature, i.e. blades for hockey skates.

The present invention is concerned both with an improved method of manufacturing skate blades as well as with an improved manner of mounting such a blade in a superstructure of molded plastic material to form a skate. Throughout this specification the term "skate" is used to refer to this combination of blade and superstructure. The boot portion, to which the superstructure is in turn secured, is considered as a separate item and, for purposes of this specification, is not part of the "skate". The present invention is not concerned with the boot portion which is assumed to be conventional; accordingly such boot portion has not been shown in the specific examples illustrated in the drawings.

It is known to form a skate superstructure of molded plastic material and to provide such superstructure with a groove for receiving the upper edge of a blade, the blade being fixed in this groove by means of bolts that extend up into the superstructure where they are engaged and tightened by respective nuts. Such an arrangement is disclosed in my U.S. Pat. No. 4,074,909 issued Feb. 21, 1978 (Canadian application No. 258,944 filed Aug. 12, 1976).

SUMMARY OF THE INVENTION

In one aspect, the present invention is directed towards an improvement in this prior arrangement and can be defined as an ice skate comprising (a) an elongated blade having an ice-engaging edge and an upper edge opposite the ice-engaging edge;

(b) a superstructure defining a downwardly facing groove firmly engaging the upper edge of the blade;

(c) a lug secured to a first end of the blade to project from said upper edge in an upward direction and in a first longitudinal direction of the blade;

(d) a slot in a first end of the superstructure for receiving said lug upon entry of the blade when inserted into the groove upwardly and in said first longitudinal direction, said slot including a surface engaging the lug to prevent downward withdrawal of the blade from the groove while permitting such withdrawal in the longitudinal direction reverse from said first direction; and (e) releasable securing means for securing the other end of the blade to the other end of the superstructure whereby to prevent movement of the blade out of the groove and in said reverse longitudinal direction.

Preferably the releasable securing means is accessible from a location on the exterior of an end surface of the superstructure so as to be accessible at all times, i.e. without regard to whether or not a boot is mounted on the toe and heel support posts of the superstructure.

In another aspect the invention is concerned with a method of manufacturing blades for use in skates of the type described. Each blade will have a main portion of uniform depth, i.e. its upper and lower edges will be curvilinearly parallel to each other. In the case of a figure skate it will also have an enlarged head portion containing a serrated surface. The method consists of cutting a series of the main blade portions from contiguous areas of steel stock by means of cuts each of which simultaneously forms an upper edge of one main portion and a lower edge of the next. When making figure skates the head portions are cut alternately from portions of the stock extending beyond opposite ends of the main portions.

Subsequently a lug can be fixed to one end of the upper edge of such a blade and either a bolt or a lug for receiving a bolt fixed to the other end, thus producing a blade suitable for assembly with a superstructure in the manner already described.

The invention also relates to a blade when so formed.

BRIEF DESCRIPTION OF THE DRAWINGS

The accompanying drawings illustrate by way of example certain preferred embodiments of the invention. In these drawings.

DESCRIPTION OF PREFERRED EMBODIMENTS

Figure 1:
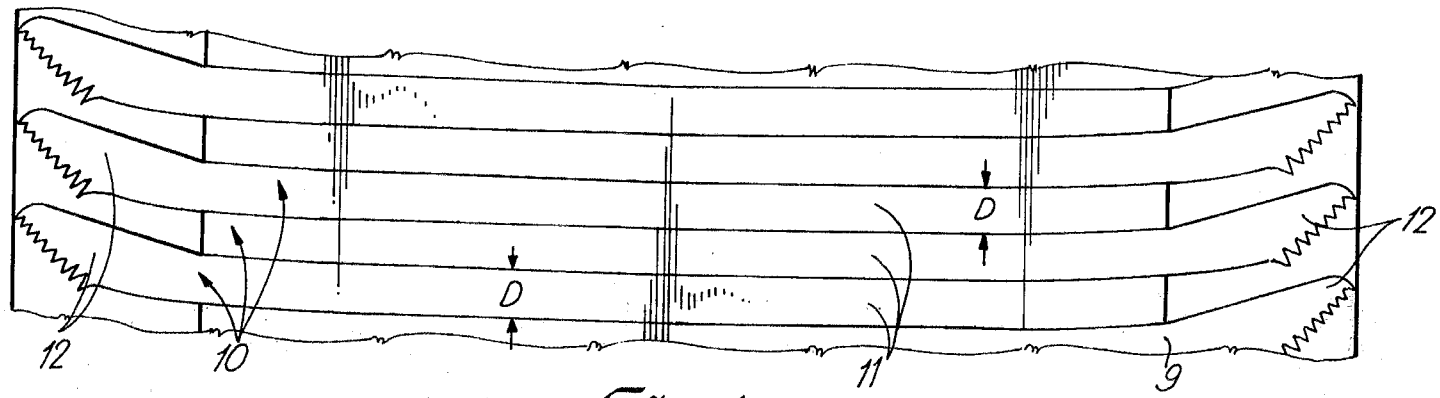
FIG. 1 is an elevation view of a sheet of steel showing how blades can be cut therefrom.

FIG. 1 shows a sheet 9 of hardened steel of a type suitable for the manufacture of skate blades. The pattern shown on this sheet 9 represents a series of blades 10 disposed alternately in opposite orientations so that the slightly curved upper edge of the main portion 11 of the lowermost blade 10 is contiguous with the similarly curved lower edge of the main portion 11 of the blade 10 next above the lowermost one, and so on. This arrangement is made possible by the fact that each main portion 11 has a uniform depth D throughout its length. In other words, the upper and lower edges of each main portion are curvilinearly parallel to each other. In the manufacture of these blades, the steel sheet 9 is stamped out or otherwise cut by a conventional machine for this purpose, along the lines shown in FIG. 1. During this process, not only are the main portions 11 of the respective blades separated from each other along their common juncture lines, but also the serrated head portions 12 of each blade are cut from the steel stock.

This method of cutting out a series of alternately oriented blades from a single sheet is especially economical, since the volume of wasted steel is very low, being confined to the areas around the head portions 12. Since the conventional way of cutting blades out of stock is to do so with all the blades oriented in the same sense, the economy obtained by the present "alternate" method is especially notable in the case of figure skate blades, because the enlarged head portions of this type of blade normally give rise to a need for the main portions of the blades to be spaced apart a significant distance from each other. This spacing is not only wasteful of steel but necessitates two cuts where, in the present method, one suffices, since a single cut simultaneously defines the upper edge of the lowermost blade and the lower edge of the next blade above, at least as far as the main portions of the blades are concerned. The present method is thus economical in the number of cuts needed, as well as in the amount of steel consumed. Reduction in the number of cuts per blade causes a corresponding reduction in the linear cut length per blade, which in turn reduces the tonnage of the press needed.

Figure 2:
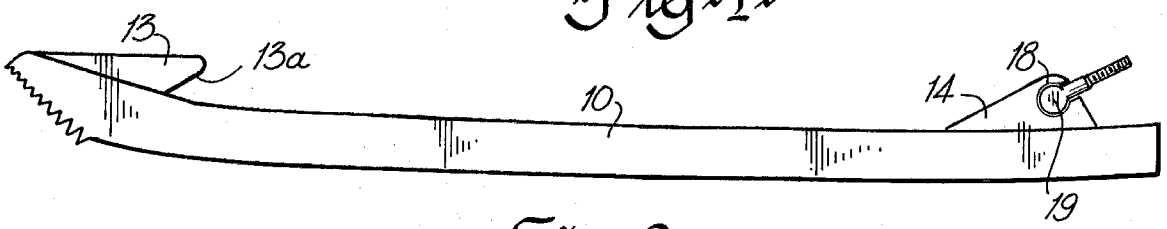
FIG. 2 is an elevation view of such a blade at a later stage in its manufacture.
Figure 3:
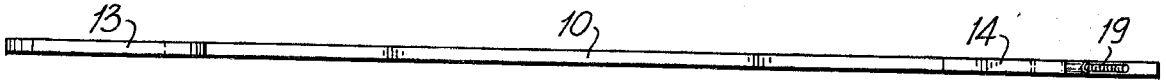
FIG. 3 is a plan view of FIG. 2.

FIGS. 2 and 3 show a blade 10 that has been cut from the sheet 9 in this way and has subsequently had lugs 13 and 14 secured to its respective ends in a suitable manner, such as by welding. The choice of the specific shapes of these lugs is determined by the complementary slots 15 and 16 formed in the underside of the molded plastic superstructure 17 (FIGS. 4 to 6), in which slots the lugs 13 and 14 snuggly engage when the blade is inserted into a groove 18 that extends along the underside of the superstructure 17.

The lug 14 is formed with a keyhole shaped slot 18 into which the head of a bolt 19 can be slipped from the side. The blade 10 is inserted into the superstructure 17 by movement in an upward and forward longitudinal direction, i.e. to the right in FIG. 5, so that the lug 13 slides into tight engagement with the slot 15 while the lug 14 enters the slot 16 and the bolt 19 passes through a hole 20 to be secured by a nut 21 located in a cavity 22 formed in the end surface of the superstructure 17. The direction to the right has been termed the "forward" longitudinal direction because it is the direction of insertion of the blade. It is actually towards the rear of the skate in the embodiment illustrated, although this is not an essential feature of the invention. The forward or inserting direction of the blade could also be made the forward direction of the skate by reversing the lugs 13 and 14 relative to head portion 12.

Figure 5:
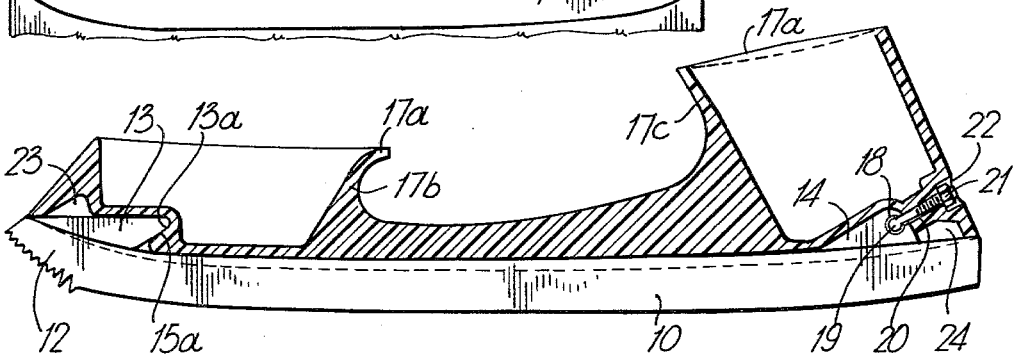
FIG. 5 is a similar section showing a blade secured in such superstructure to form a skate.

The blade is now locked in place by the bolt and nut combination at one end; at the other end it is held by the surface 13*a* of the lug 13 which engages the slot surface 15*a* and hence prevents withdrawal of the blade from the groove 18 except with movement in the "reverse" longitudinal direction, i.e. to the left in FIG. 5.

Figure 9:
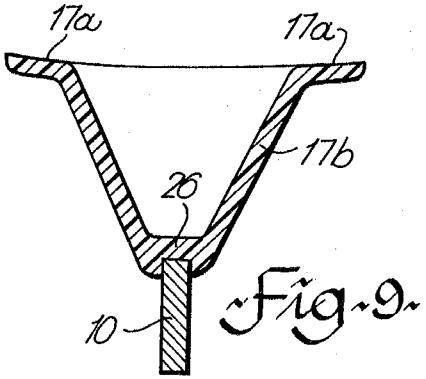
FIG. 9 is a section on line 9—9 in FIG. 6.

Replacement of a worn blade can thus be very readily achieved merely by removal of the nut 21. Note that this nut is accessible from the exterior of the end wall of the skate without the need first to remove a boot that will likely have been permanently or semi-permanently secured to the rims 17*a* provided for this purpose at the tops of hollow toe and heel support posts 17*b* and 17*c* of the superstructure. More details of the shapes of such posts and rims are given in my prior patent referred to above. See also FIG. 9. Replacement of a worn bolt 19 is also facilitated by the non-permanent nature of the engagement between the bolt 19 and the lug 14. Also, different figure skating blades are often needed to meet various ice conditions, and the requirements of competition necessitate different blade styles. Such changes are facilitated.

Figure 8:
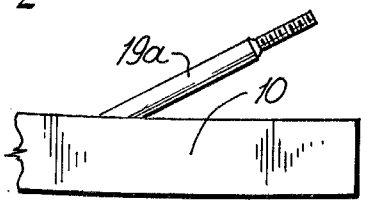
FIG. 8 is a fragmentary view of an alternative rear end of a blade.
Figure 7:
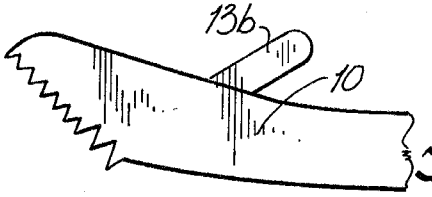
FIG. 7 is a fragmentary view of an alternative front end of a blade.

FIG. 7 shows an alternative shape of lug 13*b* which functions in basically the same manner as the lug 13, and FIG. 8 shows an alternative construction for the rear of the skate, the lug 14 being dispensed with and a bolt 19*a* being fixed (e.g. welded) directly to the blade 10.

It will be apparent that many alternatives will be possible for the connections between blade and superstructure especially at the rear of the skate. For example, instead of being mounted on the blade, an inclined bolt could extend inwardly from the exterior to engage a threaded portion of a lug fixed to the blade. In this case no nut would be needed, the bolt head appearing in the cavity 22. Essentially what is required is that one end of the skate be fitted with some form of releasable securing means. This securing means can be said to be composed of some fixture on the blade (lug and bolt; bolt; or just screw-threaded cavity) that cooperates with a complementary form of retaining device in the superstructure, e.g. a nut, bolt or the like, plus the necessary surfaces, such as the hole 20 and the bottom surface of the cavity 22, against which the nut or bolt head bears to hold the parts firmly together. Specifically, this combination which forms the securing means must hold the blade against downward movement out of the groove as well as against movement in the "reverse" longitudinal direction, i.e. the direction opposite to the "forward" or insertion direction.

At the front of the skate the lug 13 or 13*b* could be replaced by a hook-shaped lug. It should also be mentioned that it is not essential to the present invention (although preferred) that the lug 13, 13*b* or equivalent and the bolt 19, 19*a* or equivalent project in the same longitudinal direction. The lug 13 etc. must project in a selected longitudinal direction which becomes the so-called insertion or forward direction, so that such lug can only be withdrawn and the blade disengaged from the superstructure with movement in the reverse longitudinal direction. Provided the bolt 19 etc. and its associated parts, e.g. the lug 14, prevent such reverse movement, the releasable securing means will have served its purpose, without the bolt necessarily projecting up from the blade at the same inclination as the lug 13. For example, the lug 13 might extend to the left in FIG. 2 with the bolt 19 still extending to the right, or both parts could extend towards the center of the skate. In this latter case, access to the nut or other external fixing device of the releasable securing means could be from a surface of one of the toe and heel support posts that faces the central "cut-out" portion of the superstructure between such posts. It would then still be accessible when the rims 17*a* were secured to a boot.

Figure 10:
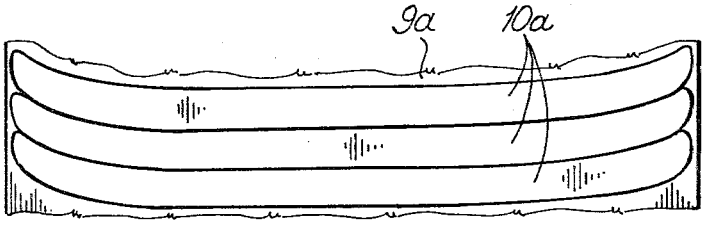
FIG. 10 is a modified version of FIG. 1.

FIG. 10 shows how hockey blades 10*a* can be cut in nested fashion from sheet 9*a*, analogously to the method of FIG. 1. It is clear that essentially the same economy of steel is achieved, although it is no longer necessary to alternate the blades, since their two ends can be maintained curvilinearly parallel. The economy flows from the ability to nest the blades closely against each other, which in turn results from the smoothly and similarly curved upper and lower blade edges and the absence of any projections from these edges. As before, a single cut simultaneously defines the upper edge of one blade and the lower edge of the next.

After having been cut out from the sheet 9*a* in this manner each blade 10*a* will have secured to it the necessary means for mounting the blade in a superstructure, e.g. either lugs 13 and 14 or one of the other variations mentioned above, or fixing devices as shown in the prior patent referred to above.

Figure 4:
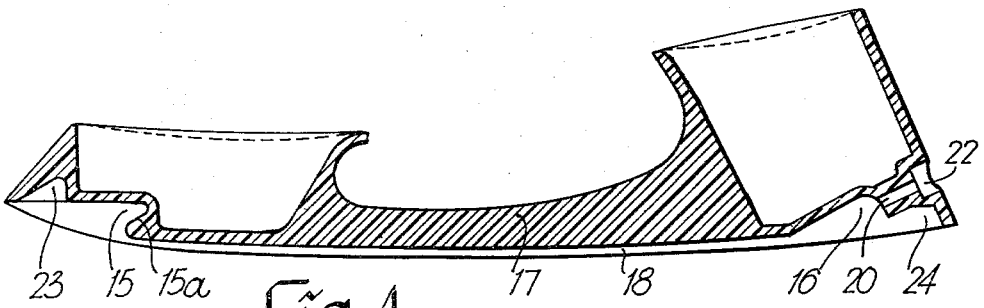
FIG. 4 is a section taken on a central longitudinal plane through a superstructure.
Figure 6:
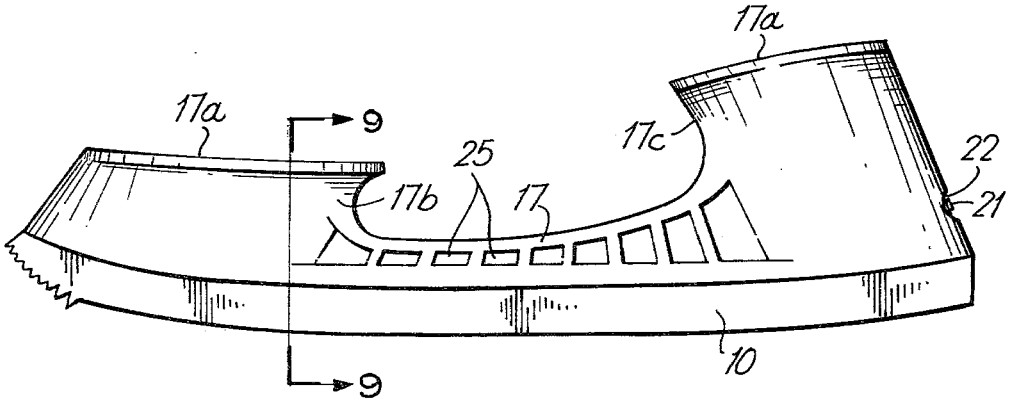
FIG. 6 is an elevation view of the skate of FIG. 5.

FIGS. 4 to 6 show additional cavities 23 and 24 in the underside of the superstructure 17, which are not occupied by the blade, as well as cavities 25 in the outer surface of the superstructure. The purpose of these cavities is to maintain the maximum thickness of the material of the superstructure at no more than a preferred value, e.g. ⅛", which avoids forming weak spots, especially when the plastic material chosen for the superstructure is a polycarbonate. Note also from FIG. 9 that the bridging portion 26 enhances the durability of the construction.

I claim:

1. An ice skate comprising (a) an elongated blade having an ice-engaging edge and an upper edge opposite the ice-engaging edge;

(b) a superstructure defining a downwardly facing groove firmly engaging the upper edge of the blade;

(c) a lug secured to a first end of the blade to project from said upper edge in an upward direction and in a first longitudinal direction of the blade;

(d) a slot in a first end of the superstructure for receiving said lug upon entry of the blade when inserted into the groove upwardly and in said first longitudinal direction, said slot including a surface engaging the lug to prevent downward withdrawal of the blade from the groove while permitting such withdrawal in the longitudinal direction reverse from said first direction; and (e) releasable securing means for securing the other end of the blade to the other end of the superstructure whereby to prevent movement of the blade out of the groove and in said reverse longitudinal direction, (f) wherein said releasable securing means is accessible from a location on the exterior of said other end of the superstructure not occluded by a boot mounted on said superstructure, (g) wherein said releasable securing means comprises an inclined bolt extending from the blade in the upward and first longitudinal direction through a hole in the superstructure, and a nut engaging a threaded portion of said bolt and bearing against the superstructure, (h) wherein said nut is located in a cavity in an outer face of an end wall of the superstructure, and (i) wherein said superstructure includes hollow toe and heel support posts extending upwardly from the blade and terminating in rims for securing to a boot, and wherein said end wall is a wall of one of said posts.

2. An ice skate comprising (a) an elongated blade having an ice-engaging edge and an upper edge opposite the ice-engaging edge;

(b) a superstructure defining a downwardly facing groove firmly engaging the upper edge of the blade;

(c) a lug secured to a first end of the blade to project from said upper edge in an upward direction and in a first longitudinal direction of the blade;

(d) a slot in a first end of the superstructure for receiving said lug upon entry of the blade when inserted into the groove upwardly and in said first longitudinal direction, said slot including a surface engaging the lug to prevent downward withdrawal of the blade from the groove while permitting such withdrawal in the longitudinal direction reverse from said first direction; and (e) releasable securing means for securing the other end of the blade to the other end of the superstructure whereby to prevent movement of the blade out of the groove and in said reverse longitudinal direction;

(f) said superstructure including toe and heel support posts extending upwardly from the blade for securing to a boot, one of said posts having a wall that forms an end wall of the superstructure, and (g) said releasable securing means including a fixing portion recessed in a cavity in said end wall whereby said fixing portion is accessible from the exterior of the superstructure without occlusion by a boot mounted on the superstructure for securing and releasing the blade, said end wall extending upwardly from the blade to the boot securing means to form a smooth end of the skate.

3. An ice skate according to claim 2, wherein said first longitudinal direction extends from said first end towards said other end.

4. An ice skate according to claim 2, wherein said releasable securing means comprises an inclined bolt extending from the blade in the upward and first longitudinal direction through a hole in the superstructure, and wherein said fixing portion is a nut engaging a threaded portion of said bolt and bearing against the superstructure.

5. An ice skate according to claim 4, wherein said bolt is permanently secured to the upper edge of said blade.

6. An ice skate according to claim 4 wherein said bolt is removably secured to said blade by engagement of an enlarged head of the bolt in a keyhole slot formed in a lug secured to the upper edge of said blade.

7. An ice skate according to claim 2, wherein said toe and heel support posts are hollow and extend upwardly from the blade to terminate in rims for securing to a boot.

* * * * *